US009103622B2

(12) United States Patent
Park et al.

(10) Patent No.: US 9,103,622 B2
(45) Date of Patent: Aug. 11, 2015

(54) BOW

(71) Applicant: WIN & WIN Co., Ltd., Gyeonggi-do (KR)

(72) Inventors: Dong Won Park, Seoul (KR); Jae Seon You, Gyeonggi-do (KR); Chang Ho Yi, Incheon (KR)

(73) Assignee: WIN & WIN Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/295,705

(22) Filed: Jun. 4, 2014

(65) Prior Publication Data

US 2014/0360479 A1 Dec. 11, 2014

(30) Foreign Application Priority Data

Jun. 5, 2013 (KR) ..... 10-2013-0064817

(51) Int. Cl.

| | |
|---|---|
| ***F41B 5/00*** | (2006.01) |
| ***F41B 5/14*** | (2006.01) |
| ***F41B 5/20*** | (2006.01) |
| ***F41B 5/10*** | (2006.01) |

(52) U.S. Cl.

CPC ..... *F41B 5/1426* (2013.01); *F41B 5/0026* (2013.01); *F41B 5/0031* (2013.01); *F41B 5/0052* (2013.01); *F41B 5/10* (2013.01)

(58) Field of Classification Search

CPC ..... F41B 5/10; F41B 5/0026; F41B 5/1426; F41B 5/0031; F41B 5/0052

USPC ..... 124/23.1, 25.6, 86, 88, 89

See application file for complete search history.

(56) References Cited

U.S. PATENT DOCUMENTS

| | | | | | |
|---|---|---|---|---|---|
| 3,814,075 | A | * | 6/1974 | Hoyt, Jr. | 124/23.1 |
| 3,942,506 | A | * | 3/1976 | Izuta | 124/23.1 |
| 4,494,521 | A | * | 1/1985 | Quartino | 124/23.1 |
| 4,574,766 | A | * | 3/1986 | Izuta | 124/23.1 |
| 4,674,468 | A | * | 6/1987 | Izuta | 124/23.1 |
| 5,231,970 | A | * | 8/1993 | Ploot et al. | 124/23.1 |
| 5,339,790 | A | * | 8/1994 | Smith | 124/25.6 |
| 5,433,792 | A | * | 7/1995 | Darlington | 124/25.6 |
| 5,464,001 | A | * | 11/1995 | Peck | 124/25.6 |
| 5,487,373 | A | * | 1/1996 | Smith | 124/23.1 |
| 5,507,270 | A | * | 4/1996 | Smith | 124/23.1 |
| 5,515,836 | A | * | 5/1996 | Martin et al. | 124/23.1 |
| 5,592,929 | A | * | 1/1997 | Hoyt, Jr. | 124/23.1 |
| 5,660,158 | A | * | 8/1997 | Rudolph | 124/23.1 |
| 5,720,267 | A | * | 2/1998 | Walk | 124/23.1 |
| 5,722,380 | A | * | 3/1998 | Land et al. | 124/25.6 |
| 5,762,060 | A | * | 6/1998 | Larson | 124/88 |
| 6,024,076 | A | * | 2/2000 | Laborde et al. | 124/23.1 |
| 6,244,259 | B1 | * | 6/2001 | Adkins | 124/23.1 |

(Continued)

*Primary Examiner* — Alvin Hunter
*Assistant Examiner* — Alexander Niconovich
(74) *Attorney, Agent, or Firm* — Berenato & White, LLC

(57) ABSTRACT

Provided is bow including: a handle; a pair of wings; and a bow string, wherein a coupling pin is formed in a rear side of one end of each wing coupled to the handle, and a fitting groove is formed at one end of each wing, wherein a coupling groove into which the coupling pin of each wing is coupled is formed at one end of the handle, and a fixing pin that is inserted into the fitting groove of each wing is formed at the one end of the handle, and wherein a buffer pin member that is configured to include a pin member that is inserted into an insertion hole formed in each wing and coupled to the handle and a first cushioning member that is formed between a front end of the pin member and each wing, is provided at each end of the handle.

10 Claims, 8 Drawing Sheets

(56) References Cited

U.S. PATENT DOCUMENTS

| | | | | |
|---|---|---|---|---|
| 6,360,734 | B1 * | 3/2002 | Andrews | 124/23.1 |
| 6,526,957 | B1 * | 3/2003 | Leven | 124/89 |
| 6,543,432 | B2 * | 4/2003 | Andrews et al. | 124/23.1 |
| 7,077,116 | B1 * | 7/2006 | Darlington | 124/23.1 |
| 7,308,890 | B1 * | 12/2007 | Wheeler | 124/23.1 |
| 7,334,575 | B2 * | 2/2008 | McPherson | 124/23.1 |
| 7,584,750 | B2 * | 9/2009 | Chang | 124/25 |
| 7,784,452 | B1 * | 8/2010 | Kronengold et al. | 124/23.1 |
| 8,281,773 | B2 * | 10/2012 | Dahl et al. | 124/25.6 |
| 2004/0187855 | A1 * | 9/2004 | Wheeler | 124/25.6 |
| 2006/0011181 | A1 * | 1/2006 | Andrews | 124/23.1 |
| 2009/0145411 | A1 * | 6/2009 | Sims et al. | 124/25.6 |
| 2011/0120436 | A1 * | 5/2011 | Eee | 124/25.6 |
| 2013/0047971 | A1 * | 2/2013 | Jolley et al. | 124/23.1 |

* cited by examiner

BOW

CROSS-REFERENCE TO RELATED APPLICATION AND CLAIM TO PRIORITY

This application claims the benefit of Korean Patent Application No. 10-2013-0064817, filed on Jun. 5, 2013, in the Korean Intellectual Property Office, the disclosure of which is incorporated herein by reference.

FIELD OF THE INVENTION

The present invention relates to a bow, and more particularly, to a bow that attenuates vibration generated at the ends of wings coupled to a handle when using the bow, to thus improve accuracy of an arrow.

BACKGROUND OF THE INVENTION

As shown in FIG. 1, a bow that is currently being used is configured to include: a handle 10 at a central portion of which a grip portion 11 is formed in which the grip portion 11 is gripped by a user; a pair of wings 20 that are respectively coupled to both ends of the handle 10; and a bow string 30 that is tied between the wings 20. Further, as shown in FIG. 2, the handle 10 is combined with each wing 20 in which a fixing pin 12 formed in the handle 10 is inserted into a fitting groove 21 formed in each wing 20 to thus support one end of each wing 20, and a coupling pin 22 of each wing 20 is coupled with a coupling groove 13 formed in each end of the handle 10.

However, when such an existing bow is used and thus the bow string 30 is pulled, the bow wings 20 may be bent backward. Accordingly, as shown in FIG. 2, a minute displacement (that is shown as alternated long and short dash lines in FIG. 2) may occur at one end portion of each wing 20 coupled to the handle 10. This displacement may occur and be finally transferred to the handle 10, together with vibration generated by the wings during firing of an arrow, to thereby cause degradation of accuracy of the arrow. Here, if an interval between the fixing pin 12 and the coupling groove 13 that play a role of fixing each wing 20 is narrowed in order to reduce the displacement, an amplitude of the vibration becomes small, but the vibration is long-lasting, while if the interval is widened, a speed of attenuating the vibration becomes large, but the amplitude of the vibration becomes widened.

SUMMARY OF THE INVENTION

To solve the above conventional problems or defects, it is an object of the present invention to provide a bow that attenuates vibration generated from one end portion of each of wings coupled to both end portions of a handle and simultaneously absorbs the vibration rapidly, thereby improving accuracy of an arrow.

To accomplish the above and other objects of the present invention, according to an aspect of the present invention, there is provided a bow comprising: a handle at a central portion of which a grip portion is formed in which the grip portion is gripped by a user; a pair of wings that are respectively coupled to both ends of the handle; and a bow string that is tied between the pair of the wings, wherein a coupling pin is formed in one side of a rear side of one end of each wing coupled to the handle, and a fitting groove is formed at one end of each wing, wherein a coupling groove into which the coupling pin of each wing is coupled is formed at one end of the handle to which each wing is coupled, and a fixing pin that is inserted into the fitting groove of each wing to support one end of each wing is formed at the one end of the handle to which each wing is coupled, and wherein a buffer pin member that is configured to include a pin member that is inserted into an insertion hole formed in each wing and coupled to the handle and a first cushioning member that is formed between a front end of the pin member and each wing, is provided at each end of the handle to which each wing is coupled, to thereby attenuate vibration generated at the one end of each wing coupled to the handle when using the bow, to thus improve accuracy of an arrow.

Preferably but not necessarily, the insertion hole formed in each wing is formed between the fitting groove and the coupling pin that are formed in each wing.

Preferably but not necessarily, the pin member of the buffer pin member is detachably screwed with the handle.

Preferably but not necessarily, a second cushioning member is provided between the handle and each wing in the pin member.

According to another aspect of the present invention, there is also provided a bow comprising: a handle at a central portion of which a grip portion is formed in which the grip portion is gripped by a user; a pair of wings that are respectively coupled to both ends of the handle; and a bow string that is tied between the pair of the wings, wherein a coupling pin is formed in a rear side of one end of each wing coupled to one end of the handle, and a fitting groove is formed at one end of each wing, wherein a coupling groove into which the coupling pin of each wing is inserted is formed at one end of the handle to which each wing is coupled, and a fixing pin that is inserted into the fitting groove of each wing is formed at the one end of the handle to which each wing is coupled, and wherein a buffer pin member that is configured to include a pin member that is inserted into an insertion hole formed in the handle and is coupled to one end of each wing and a cushioning member that is formed between a rear end of the pin member and the handle, is provided at each end of the handle to which each wing is coupled, to thereby attenuate vibration generated at the one end of each wing coupled to the handle when using the bow, to thus improve accuracy of an arrow.

Preferably but not necessarily, the pin member is combined with each wing between the fitting groove and the coupling pin of each wing.

According to still another aspect of the present invention, there is also provided a bow comprising: a handle at a central portion of which a grip portion is formed in which the grip portion is gripped by a user; a pair of wings that are respectively coupled to both ends of the handle; and a bow string that is tied between the pair of the wings, wherein a coupling pin is formed in one side of a rear side of one end of each wing coupled to one end of the handle, and a fitting groove is formed at one end of each wing, wherein a coupling groove into which the coupling pin of each wing is inserted is formed at one end of the handle to which each wing is coupled, and a fixing pin that is inserted into the fitting groove of each wing is formed at the one end of the handle to which each wing is coupled, and wherein a front support portion that is located in front of one end of each wing is formed at each end of the handle to which each wing is coupled, and a cushioning member is provided between the front support portion and each wing, to thereby attenuate vibration generated at the one end of each wing coupled to the handle when using the bow, to thus improve accuracy of an arrow.

Preferably but not necessarily, the front support portion is bent at both sides of the handle positioned at both sides of each wing, and is positioned in front of each wing.

According to yet another aspect of the present invention, there is also provided a bow comprising: a handle at a central portion of which a grip portion is formed in which the grip portion is gripped by a user; a pair of wings that are respectively coupled to both ends of the handle; and a bow string that is tied between the pair of the wings, wherein a coupling pin is formed in one side of a rear side of one end of each wing coupled to one end of the handle, and a fitting groove is formed at one end of each wing, wherein a coupling groove into which the coupling pin of each wing is inserted is formed at one end of the handle to which each wing is coupled, and a fixing pin that is inserted into the fitting groove of each wing is formed at the one end of the handle to which each wing is coupled, and wherein a buffer pin member that is configured to include a pin member that is formed between both sides of the handle that is positioned at both sides of each wing and that is disposed in front of each wing, and a cushioning member that surrounds the outer circumferential surface of the pin member is provided at one end of the handle to which one end of each wing is coupled, to thereby attenuate vibration generated at the one end of each wing coupled to the handle when using the bow, to thus improve accuracy of an arrow.

As described above, the bow according to the present invention suppresses displacement at one end of each wing coupled to the handle, and simultaneously attenuates vibration generated at the one end of each wing, to also rapidly absorb the vibration and to thereby provide an effect of improving accuracy of an arrow.

DETAILED DESCRIPTION OF THE PREFERRED EMBODIMENT(S)

The above and/or other objects and/or advantages of the present invention will become more apparent by the following description.

Hereinbelow, a bow according to a preferred embodiment of the present invention will be described in more detail with reference to the accompanying drawings.

Figure 3:
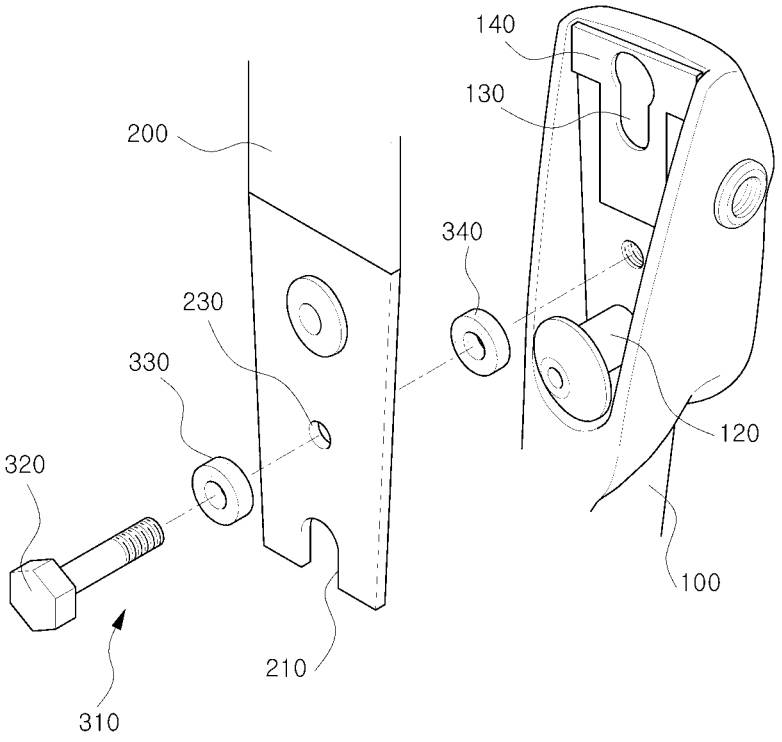
FIG. 3 is a partially exploded perspective view of a bow according to a first embodiment of the present invention.
Figure 4:
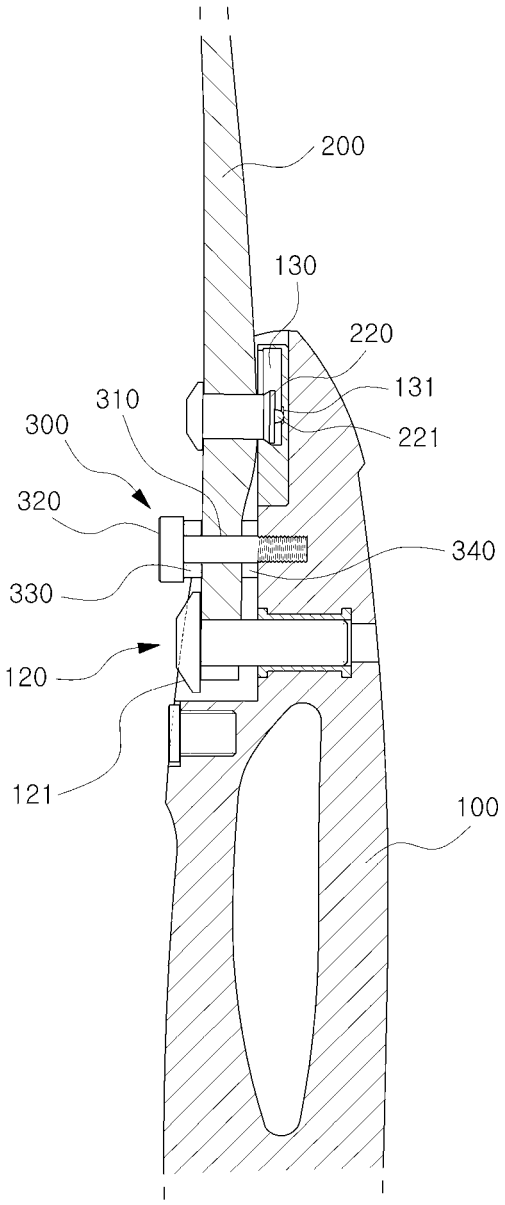
FIG. 4 is a side view of a portion of the bow according to the first embodiment of the present invention.

FIG. 3 is a partially exploded perspective view of a bow according to a first embodiment of the present invention. FIG. 4 is a side view of a portion of the bow according to the first embodiment of the present invention. In FIGS. 3 and 4, an upper end of a handle 100 and one wing 200 coupled to the upper end of the handle 100 are shown, but a coupling structure of a lower end of the handle 100 and the other wing is also the same as that of the upper end of the handle 100 and the one wing 200.

Figure 1:
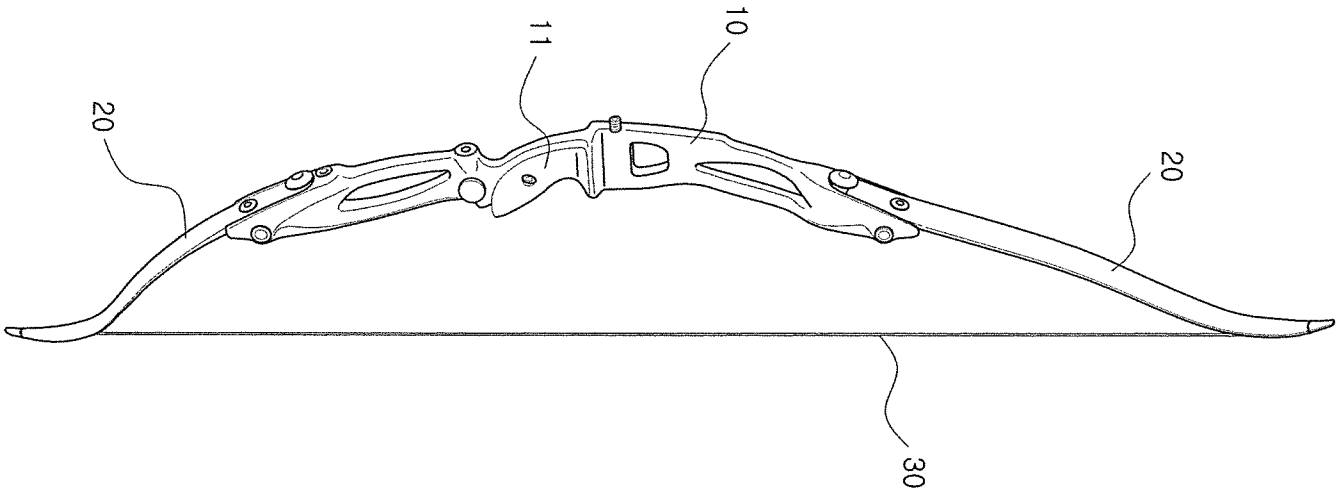
FIG.1 Prior Art
FIG. 1 is a perspective view of a conventional bow.
Figure 2:
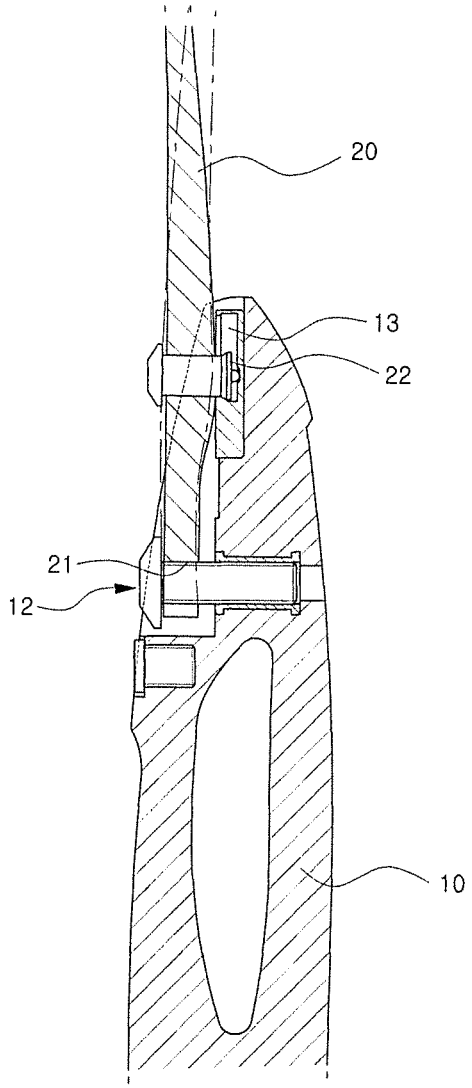
FIG.2 Prior Art
FIG. 2 is a partially enlarged view of FIG. 1.

As illustrated, the bow according to the first embodiment of the present invention includes: an elongated handle 100 extending in a generally longitudinal direction and having a pair of longitudinally opposite end and a central portion between the opposite ends of the handle 100; a pair of wings 200 that extend in the generally longitudinal direction and are respectively coupled to the longitudinally opposite ends of the handle 100; and a bow string that is tied between the pair of the wings 200. A grip portion 11, best shown in FIG. 1, is formed at the central portion of the elongated handle 100. The grip portion 11 is adapted to be gripped by a user. Here, a coupling pin 220 is formed in a rear side of one end of each wing 200 coupled to the handle 100, and a fitting groove 210 is formed at one end of each wing 200. In addition, a coupling groove 130 into which the coupling pin 220 of each wing 200 is coupled is formed at one end of the handle 100 to which each wing 200 is coupled, and a fixing pin 120 that is inserted into the fitting groove 210 of each wing 200 is formed at the one end of the handle 100 to which each wing 200 is coupled. In addition, a buffer pin member 300 that is configured to include a pin member 310 that is inserted into an insertion hole 230 formed in each wing 200 and is coupled to one end of the handle 100 and a first cushioning member 330 that is formed between a front end 320 of the pin member 310 and each wing 200, is provided at each end of the handle 100 to which each wing 200 is coupled.

The grip portion 11 of FIG. 1 gripped by a user is formed at the central portion of the handle 100 and each wing 200 is coupled at one of the longitudinally opposite ends of the handle 100. Further, the coupling groove 130 is formed at each end of the handle 100 so that each wing 200 is coupled to the handle 100, and the fixing pin 120 is formed spaced apart from the coupling groove 130 to the center direction of the handle 100.

The fixing pin 120 plays a role of fixing and supporting one end of each wing 200 coupled to the handle 100, and is screwed with the handle 100 and detachably coupled to the handle 100. As best shown in FIG. 4, the fixing pin 120 comprises a pin body which is inserted into the fitting groove 210 of each wing 200 and a head portion 121 which has a larger diameter than that of the pin body and is formed at one end of the pin body in front of the fitting groove 210 to support one end of each wing 200. A protruding height of a head portion 121 can be adjusted by rotating the fixing pin 120 that is screwed with the handle 100 to thus adjust the intensity of each wing 200.

The coupling groove 130 is formed at one end of the handle 100 in which the coupling pin 220 of each wing 200 to be described later is fixedly inserted into coupling groove 130. The coupling pin 220 of each wing 200 is inserted into and through an upper portion of the coupling groove 130. Then, each wing 200 is put down toward the center of the handle 100 and is coupled with the handle 100, and an opening width of a lower portion of the coupling groove 130 is formed smaller than the size of the coupling pin 220, so as to prevent escape of the coupled coupling pin 220 in a forward direction. Further, an insertion groove 131 is formed on a bottom surface of the coupling groove 130, and a coupling projection 221 protruding to the coupling pin 220 of each wing 200 is fixedly inserted into the insertion groove 131.

Meanwhile, a T-shaped wing coupling block 140 that is detachably coupled to each end of the handle 100 is formed in the embodiment shown in FIG. 3, and the coupling groove 130 is formed in the T-shaped wing coupling block 140. However, the coupling groove 130 may be formed at each end of the handle 100 without a separate block. The shape of the coupling pin 220 can be variously modified as long as the coupling pin 220 may be inserted into and fixed to the coupling groove 130.

The fitting groove 210 having a predetermined length is formed at one end of each wing 200, so that the fixing pin 120 of the handle 100 is inserted and fixed into the fitting groove 210 so as to make each wing 200 coupled to the handle 100. In addition, the coupling pin 220 coupled to the coupling groove 130 of the handle 100 is formed at one side of a rear end of one end of each wing 200, and the coupling projection 221 that is protruded rearwards and inserted into the insertion groove 131 of the handle 100 is formed in the coupling pin 220. In addition, the insertion hole 230 into which the buffer pin member 300 is inserted is formed between the fitting groove 210 and the coupling pin 220 at one end of each wing 200.

The buffer pin member 300 plays a role of suppressing displacement caused at one end of each wing 200 coupled to the handle 100 and attenuating vibration caused at one end of each wing 200. The buffer pin member 300 includes a pin member 310 that is inserted into the insertion hole 230 of each wing 200 and is coupled to the handle 100, and a first cushioning member 330 that is formed between a front end 320 of the pin member 310 and each wing 200.

The pin member 310 of the buffer pin member 300 is inserted into the insertion hole 230 of each wing 200 and is coupled to the handle 100, and a pin head that forms the front end 320 of the pin member 310 is disposed in front of each wing 200. The pin member 310 is detachably screwed with the handle 100 between the coupling groove 130 and the fixing pin 120.

The first cushioning member 330 is coupled to the pin member 310 between the front end 320 and each wing 200. In this embodiment, the first cushioning member 330 is made of a rubber material, but a soft plastic material may be used as the first cushioning member 330.

The present invention has the above-described configuration, and thus solves the conventional problems that the conventional art may cause a displacement at one end of each wing coupled to the handle since the bow string 30 of FIG. 1 is pulled and the wings of the bow is bent back, so that such a displacement is transmitted to the handle together with vibration generated at each wing to thus drop accuracy of an arrow. That is, the bow according to the present invention has the buffer pin member 300 including the cushioning member 330 between the front end 320 of the pin member 310 coupled to the handle 100 and each wing 200, to thereby suppress the displacement of one end of each wing 200 coupled to the handle 100 and simultaneously attenuates vibration generated from each wing 200, and to also rapidly absorb the vibration to improve the accuracy of an arrow.

In addition, as illustrated in FIGS. 3 and 4 in the present invention, the buffer pin member 300 further includes a second cushioning member 340 coupled to the pin member 310 between the handle 100 and each wing 200. As such, since the second cushioning member 340 is formed even between the handle 100 and each wing 200, a vibration attenuation effect is further improved. A material of the second cushioning member 340 may be the same material as that of the first cushioning member 330.

Figure 5:
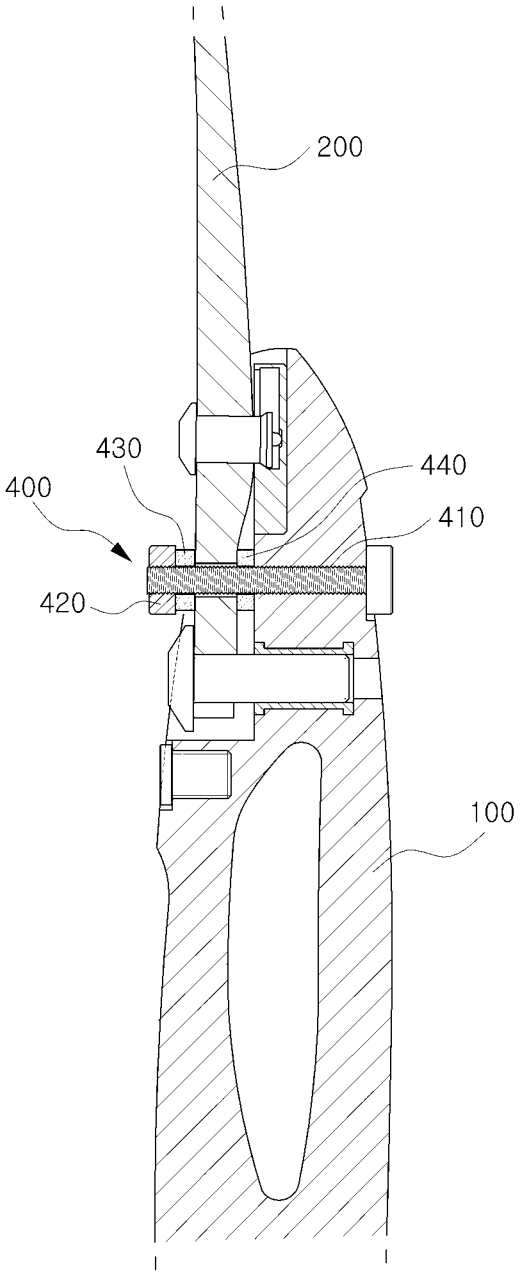
FIG. 5 is a side view of a portion of a bow according to a second embodiment of the present invention.

Next, a bow according to a second embodiment of the present invention will be described with reference to FIG. 5. FIG. 5 is a side view of a part of the bow according to the second embodiment of the present invention.

The bow according to the second embodiment is different from that of the first embodiment in view of a structure that the buffer pin member is coupled to the handle. In the first embodiment, the pin member 310 of the buffer pin member 300 is coupled in front of the bow, but in the second embodiment, a pin member 410 of a buffer pin member 400 is coupled at the back of the handle 100. Thus, the pin member 410 of the buffer pin member 400 in the second embodiment is screwed with the handle 100 and then inserted into the insertion hole 230 of each wing 200. Then, the pin member 410 is screwed with a nut 420 in front of each wing 200. Thus, in the second embodiment, a first cushioning member 430 is formed between the nut 420 forming the front end of the pin member 410 and each wing 200, and a second cushioning member 440 is formed between each wing 200 and the handle 100.

Other configuration and effects in the second embodiment are same as those in the first embodiment, and thus, the detailed description thereof is omitted here.

Figure 6:
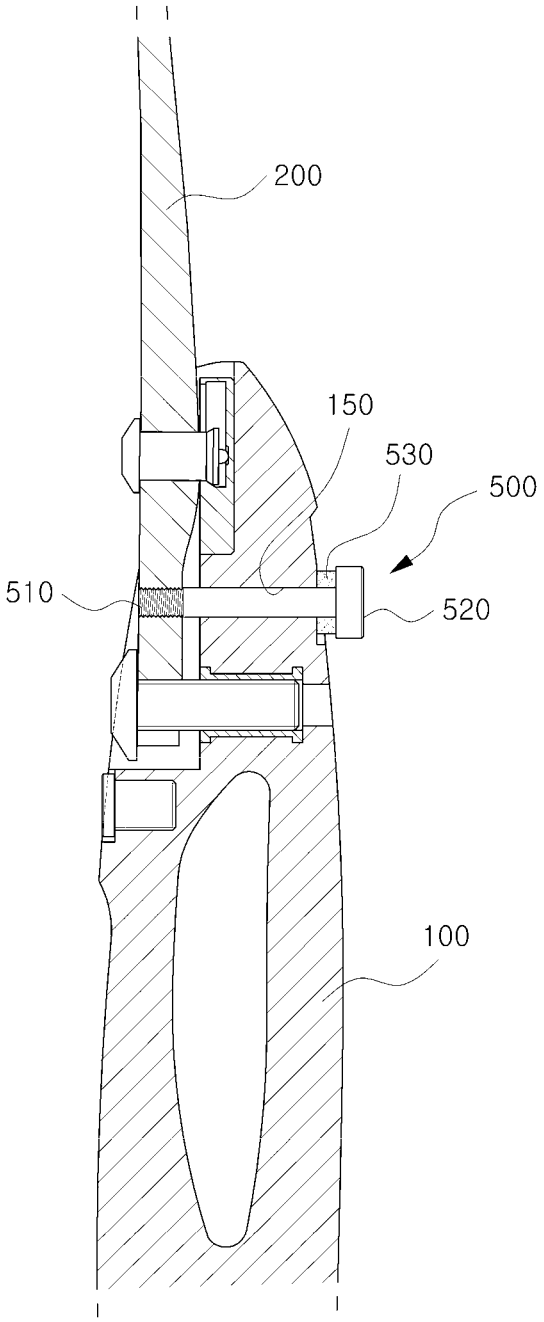
FIG. 6 is a side view of a portion of a bow according to a third embodiment of the present invention.

Next, a bow according to a third embodiment of the present invention will be described with reference to FIG. 6. FIG. 6 is a side view of a part of the bow according to the third embodiment of the present invention.

A buffer pin member 500 in the third embodiment includes a pin member 510 that is inserted into an insertion hole 150 of the handle 100 and coupled to each wing 200, and a first cushioning member 530 that is formed between a rear end 520 of the pin member 510 and the handle 100.

In the third embodiment, the pin member 510 of the buffer pin member 500 is inserted into the insertion hole 150 of the handle 100 at the rear side of the handle 100, to then be coupled to each wing 200, and a rear end 520 of the pin member 510 is disposed at the rear side of the handle 100. The pin member 510 is detachably screwed with each wing 200 between the coupling groove 130 and the fixing pin 120.

A first cushioning member 530 is coupled to the pin member 510 between the rear end 520 of the pin member 510 and the handle 100, and the material of the first cushioning member 530 is made in the same manner as that of the first embodiment.

In the third embodiment, when the pin member 510 is compared with those of the previous embodiments, the pin member 510 differs from those of previous embodiments, in that the pin member 510 is screwed with each wing 200. However, since the first cushioning member 530 is formed between the rear end 520 of the pin member 510 and the handle 100, in the third embodiment, a displacement that may occur at one end of each wing 200 coupled to the handle 100 may be suppressed as in the first embodiment, and a vibration that may be simultaneously generated may be quickly attenuated, to thereby improve accuracy of an arrow.

Further, even in the third embodiment as well as in the previous embodiments, a second cushioning member (not shown) coupled to the pin member 510 may be additionally provided between the handle 100 and each of the wings 200, to thereby further improve a vibration attenuating effect. Besides, other configuration and effects are the same as those in the previous embodiments.

Figure 7:
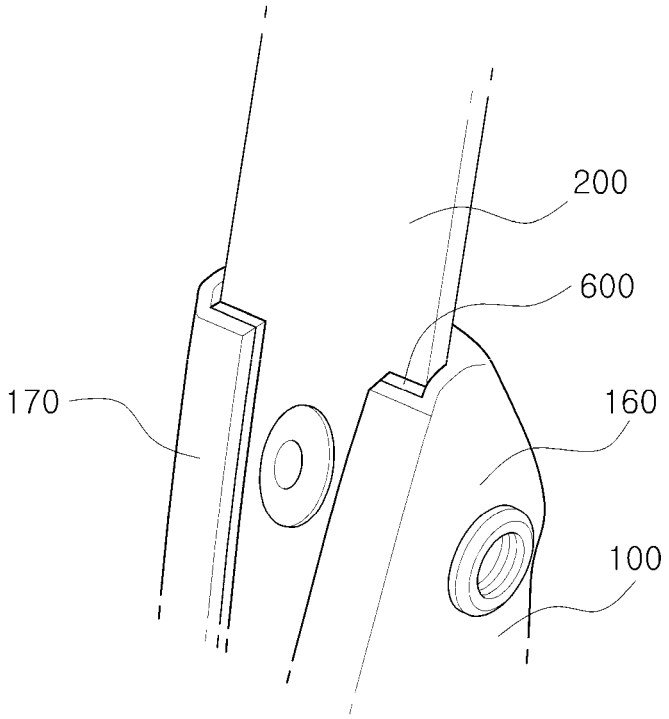
FIG. 7 is a perspective view of a portion of a bow according to a fourth embodiment of the present invention.

Next, a bow according to a fourth embodiment of the present invention will be described with reference to FIG. 7. FIG. 7 is a side view of a part of the bow according to the fourth embodiment of the present invention.

In the fourth embodiment, instead of the buffer pin member in the previous embodiments, a front support portion 170 is formed at one end of the handle 100 coupled to each wing 200 and a cushioning member 600 is provided between the front supporting portion 170 and each wing 200.

In this embodiment, the front support portion 170 is bent in an L-shaped form at both sides 160 of the handle 100 that is located at both sides of each wing 200, and is located in front of each wing 200. In addition, the front support portion 170 is formed to have a predetermined length in the longitudinal direction. In addition, the cushioning member 600 having the same length as that of the front support portion 170 is combined between the front support portion 170 and each wing 200 on the rear surface of the front supporting portion 170. The material of the cushioning member 600 is the same as those of the previous embodiments.

Thus, even in the fourth embodiment, a configuration such as the front support portion 170 and the cushioning member 600 is provided at the end of the handle to which the wings are coupled. As a result, a displacement that may occur at one end of each wing 200 coupled to the handle 100 may be suppressed, and a vibration that may simultaneously be generated may be quickly attenuated, to thereby improve accuracy of an arrow.

Figure 8:
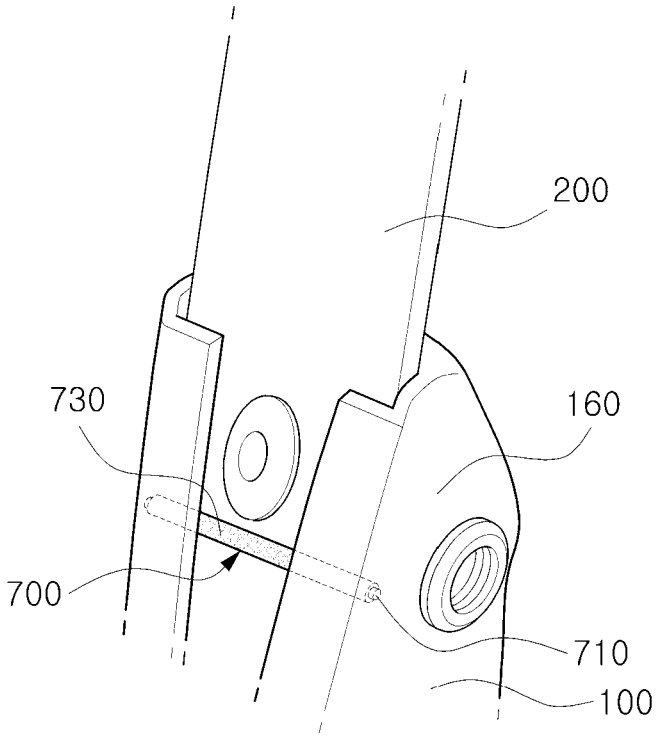
FIG. 8 is a perspective view of a portion of a bow according to a fifth embodiment of the present invention.

Next, a bow according to a fifth embodiment of the present invention will be described with reference to FIG. 8. FIG. 8 is a side view of a part of the bow according to the fifth embodiment of the present invention.

In the fifth embodiment, a buffer pin member 700 is provided to support each of wings 200 in front of each wing 200, and the buffer pin member 700 includes a pin member 710 that is formed between both sides 160 of the handle 100 in front of each wing 200, and a cushioning member 730 that surrounds the outer circumferential surface of the pin member 710.

Thus, in this embodiment, the buffer pin member 700 supports the front end of each wing to suppress displacement of each wing, and the cushioning member 730 is formed on the outer circumferential surface of the pin member 710 to attenuate vibration generated at each wing, to thereby improve accuracy of an arrow.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. A bow comprising:

a handle having a pair of longitudinally opposite ends and a central portion between the longitudinally opposite ends of the handle, a grip portion is formed at the central portion of the handle and provided to be gripped by a user;

a pair of wings respectively coupled to the longitudinally opposite ends of the handle; and a bow string tied between the pair of the wings;

a fitting groove formed at one end of each of the wings;

a coupling pin spaced in a longitudinal direction of each of the wings from the fitting groove and formed in a rear side of each of the wings coupled to the handle;

a coupling groove, into which the coupling pin of each wing is coupled, is formed at one end of the handle to which each of the wings is coupled;

a fixing pin comprising a pin body inserted into the fitting groove of each of the wings and a head portion having a larger diameter than that of the pin body and formed at one end of the pin body in front of the fitting groove to fix one end of each of the wings to the handle and to support one end of each wing, the fixing pin formed apart from the coupling groove in a center direction of the handle;

a buffer pin member configured to include a pin member inserted into an insertion hole formed between the fitting groove and the coupling pin in each wing and coupled to the handle to suppress a displacement of each wing between one end of each wing and one end of the handle; and a first cushioning member formed between a front end of the pin member and each wing, is provided at each end of the handle to which each wing is coupled, to thereby attenuate vibration generated at the one end of each wing coupled to the handle when using the bow, to thus improve accuracy of an arrow.

2. The bow according to claim 1, wherein the pin member of the buffer pin member is detachably screwed with the handle.

3. The bow according to claim 1, wherein the first cushioning member is made of rubber.

4. The bow according to claim 1, wherein a second cushioning member is provided between the handle and each wing in the pin member.

5. The bow according to claim 4, wherein the second cushioning member is made of rubber.

6. A bow comprising:

a handle having a pair of longitudinally opposite ends and a central portion between the longitudinally opposite ends of the handle, a grip portion is formed at the central portion of the handle and provided to be gripped by a user;

a pair of wings respectively coupled to the longitudinally opposite ends of the handle; and a bow string tied between the pair of the wings;

a fitting groove formed at one end of each of the wings;

a coupling pin spaced in a longitudinal direction of each of the wings from the fitting groove and formed in a rear side of each of the wings;

a coupling groove into which the coupling pin of each wing is inserted is formed at one end of the handle to which each wing is coupled;

a fixing pin comprising a pin body inserted into the fitting groove of each wing and a head portion having a larger diameter than that of the pin body and formed at one end of the pin body in front of the fitting groove to fix one end of each of the wings, the fixing pin formed apart from the coupling groove in the center direction of the handle;

a buffer pin member configured to include a pin member inserted into an insertion hole formed between the coupling groove and the fixing pin in the handle and coupled to each wing between the fitting groove and the coupling pin of each of the wings to suppress a displacement of each wing between one end of each wing and one end of the handle; and a cushioning member formed between the handle and a rear end of the pin member positioned behind the handle and provided at each end of the handle to which each wing is coupled, to thereby attenuate vibration generated at the one end of each wing coupled to the handle when using the bow, to thus improve accuracy of an arrow.

7. The bow according to claim 6, wherein the pin member is detachably screwed with each wing.

8. The bow according to claim 6, wherein the cushioning member is made of rubber.

9. A bow comprising:

a handle having a pair of longitudinally opposite ends and a central portion between the longitudinally opposite ends of the handle, a grip portion is formed at the central portion of the handle and provided to be gripped by a user;

a pair of wings respectively coupled to the longitudinally opposite ends of the handle; and a bow string tied between the pair of the wings;

a fitting groove formed at one end of each of the wings;

a coupling pin spaced in a longitudinal direction of each of the wings from the fitting groove and formed in a rear side of each of the wings;

a coupling groove into which the coupling pin of each wing is inserted is formed at one end of the handle to which each wing is coupled;

a fixing pin comprising a pin body inserted into the fitting groove of each wing and a head portion having a larger diameter than that of the pin body and formed at one end of the pin body in front of the fitting groove to fix one end of each wing, the fixing pin formed apart from the coupling groove in the center direction of the handle to which each wing is coupled, and;

a front support portion formed integrally to the handle and bent at both lateral sides of the handle to which each wing is coupled, the front support portion is positioned in front of each wing and extends from one end of the handle toward one end of each wing; and a cushioning member is combined with a rear surface of the front support portion and is provided between the front support portion and each wing, to thereby suppress a displacement of each wing between one end of each wing and one end of the handle and attenuate vibration generated at the one end of each wing coupled to the handle when using the bow, to thus improve accuracy of an arrow.

10. A bow comprising:

a handle having a pair of longitudinally opposite ends and a central portion between the longitudinally opposite ends of the handle, a grip portion is formed at the central portion of the handle and provided to be gripped by a user;

a pair of wings respectively coupled to the longitudinally opposite ends of the handle; and a bow string tied between the pair of the wings;

a fitting groove formed at one end of each of the wings;

a coupling pin spaced in a longitudinal direction of each of the wings from the fitting groove and formed in a rear side of each of the wings;

a coupling groove into which the coupling pin of each wing is inserted is formed at one end of the handle to which each wing is coupled;

a fixing pin comprising a pin body inserted into the fitting groove of each wing and a head portion having a larger diameter than that of the pin body and formed at the one end of the pin body in front of the fitting groove to fix one end of each wing, the fixing pun formed apart from the coupling groove to the center direction of the handle;

a buffer pin member configured to include a pin member both ends of which are coupled to both lateral sides of the handle to which each of the wings is coupled, the pin member disposed transversely in front of each of the wings between the fitting groove and the coupling pin to suppress a displacement of each wing between one end of each wing and one end of the handle; and a cushioning member that surrounds the pin member to thereby attenuate vibration generated at the one end of each wing coupled to the handle when using the bow, to thus improve accuracy of an arrow.

* * * * *